US007387162B2

(12) United States Patent
Mooney, Jr. et al.

(10) Patent No.: US 7,387,162 B2
(45) Date of Patent: Jun. 17, 2008

(54) APPARATUS AND METHOD FOR SELECTIVE ACTUATION OF DOWNHOLE TOOLS

(75) Inventors: James D. Mooney, Jr., Cleburne, TX (US); Bobby R. Ford, North Richland Hills, TX (US)

(73) Assignee: Owen Oil Tools, LP, Houston, TX (US)

( * ) Notice: Subject to any disclaimer, the term of this patent is extended or adjusted under 35 U.S.C. 154(b) by 92 days.

(21) Appl. No.: 11/328,683

(22) Filed: Jan. 10, 2006

(65) Prior Publication Data

US 2007/0158071 A1 Jul. 12, 2007

(51) Int. Cl.
*E21B 29/02* (2006.01)

(52) U.S. Cl. ..... 166/297; 166/55; 166/63; 102/312

(58) Field of Classification Search ..... 166/297, 166/55, 55.2, 63; 102/312
See application file for complete search history.

(56) References Cited

U.S. PATENT DOCUMENTS 4,656,944 A 4/1987 Gonzalez
5,105,742 A 4/1992 Sumner
5,490,563 A * 2/1996 Wesson et al. ..... 166/297
5,531,164 A 7/1996 Mosley
6,543,538 B2 * 4/2003 Tolman et al. ..... 166/284
6,672,405 B2 1/2004 Tolman et al.

FOREIGN PATENT DOCUMENTS

GB 2310871 9/1997

* cited by examiner

*Primary Examiner*—David J. Bagnell
*Assistant Examiner*—Brad Harcourt
(74) *Attorney, Agent, or Firm*—Madan, Mossman & Sriram, P.C.

(57) ABSTRACT

The present invention provides systems, methods and devices for selectively firing a gun train formed of a plurality of guns. Conventionally, the guns each include a detonator assembly that detonates upon receiving a firing signal transmitted by a surface source. In one embodiment of the present invention, an operator provided in the gun train selectively couples one or more of the guns to the signal transmission medium. The operator has an safe state wherein the operator isolates the gun from the firing signal and an armed state wherein the operator enable the transmission of the firing signal to the gun. A control signal is used to move operator between the safe state and the armed state. In some embodiments, two or more guns are each provided with a separate operator. In other embodiments, one operator can selectively engage two or more guns.

18 Claims, 3 Drawing Sheets

APPARATUS AND METHOD FOR SELECTIVE ACTUATION OF DOWNHOLE TOOLS

CROSS-REFERENCE TO RELATED APPLICATIONS

NONE.

BACKGROUND OF THE INVENTION

1. Field of the Invention

The present invention relates to devices and methods for selective actuation of wellbore tools. More particularly, the present invention is in the field of control devices and methods for selective firing of a gun assembly.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In some applications, two or more guns or gun compartments are assembled to form a gun train. It is common practice to sequentially fire such perforating gun trains. Each gun is made up of a number of shaped charges, each of which is contained in a separate gun compartment. The shaped charges are usually fired sequentially, beginning at the bottom of the gun or gun compartment. The first shaped charge to be fired is connected to a ground, and the firing of that shaped charge will, unless there is a malfunction, result in the removal of that ground connection and grounding the next shaped charge in the sequence. The firing of each shaped charge, unless there is a malfunction, will result in the removal of the ground connection for that shaped charge and grounding the next shaped charge in the sequence.

Another conventional method for detonating the perforating guns includes a rotary switch operated at the surface with which the several charges can be detonated. This method, however, has its disadvantages, primarily in that the number of charges which can be detonated in this manner is limited. Another conventional method permitting sequential "select fire" detonation of the charges starting at the bottom of the gun assembly, by sequentially applying direct current (d.c.) voltage of alternating polarity to the logging cable from the surface. In accordance with this method, the logging cable is electrically connected through a diode to the blasting cap attached to the charge on the bottom of the gun assembly, and this blasting cap is grounded. All other blasting caps attached to the other charges above the bottom charge are not grounded. Instead they are electrically connected to the diode and a dart which is mounted through an insulating gasket to the baffle plate. The diode is also connected to the logging cable. The dart is a device, well known in the trade, that seals the baffle from the portion of the gun assembly below, when the charge immediately below the dart has been detonated. Other conventional selective firing devices include multiple wire-multiple shot perforating guns. In these devices, a plurality of separate circuits are employed to fire a like plurality of small groups of perforating elements. Another conventional selective firing system is the single wire-multiple shot gun. In devices of this type, there are provided a plurality of spaced normally disarmed blasting cap-perforating element assemblages and an armed assemblage. When the armed assemblage is fired, the adjacent blasting cap-perforating element assemblage is armed through the use of a mechanically operated switch.

These conventional select fire systems for various reasons, such as capacity, reliability, cost, and complexity, have proven inadequate. The present invention addresses these and other drawbacks of the prior art.

SUMMARY OF THE INVENTION

In one aspect, the present invention provides systems, methods and devices for providing selective firing of a gun train formed of a plurality of guns. Conventionally, the guns each include a detonator assembly that detonates upon receiving a firing signal transmitted by a surface source. In one embodiment of the present invention, an operator provided in the gun train selectively couples one or more of the guns to the signal transmission medium. The operator has a safe state wherein the operator isolates the gun from the firing signal and an armed state wherein the operator enable the transmission of the firing signal to the gun. A control signal is used to move operator between the safe state and the armed state. In some embodiments, two or more guns are each provided with a separate operator. In other embodiments, one operator can selectively engage two or more guns.

In one mode of operation, a gun train formed of a plurality of guns is conveyed into a wellbore. At least one of the guns is provided with an operator that selectively conveys a firing signal (or any other similar signal) to a detonator associated with the gun. In one arrangement, the operator is connected to a signal transmission medium that can convey the firing signal from the surface source. The operator includes a conductive member that initially is disengaged from the detonator. Upon receiving a control signal, the conductive member engages the detonator. After the gun train is positioned at a desired depth in the wellbore, a surface source transmits a control signal to the operator. In response, the conductive member of the operator engages and establishes a signal path to the detonator. Thereafter, a firing signal is transmitted to detonate the detonator and the first gun.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
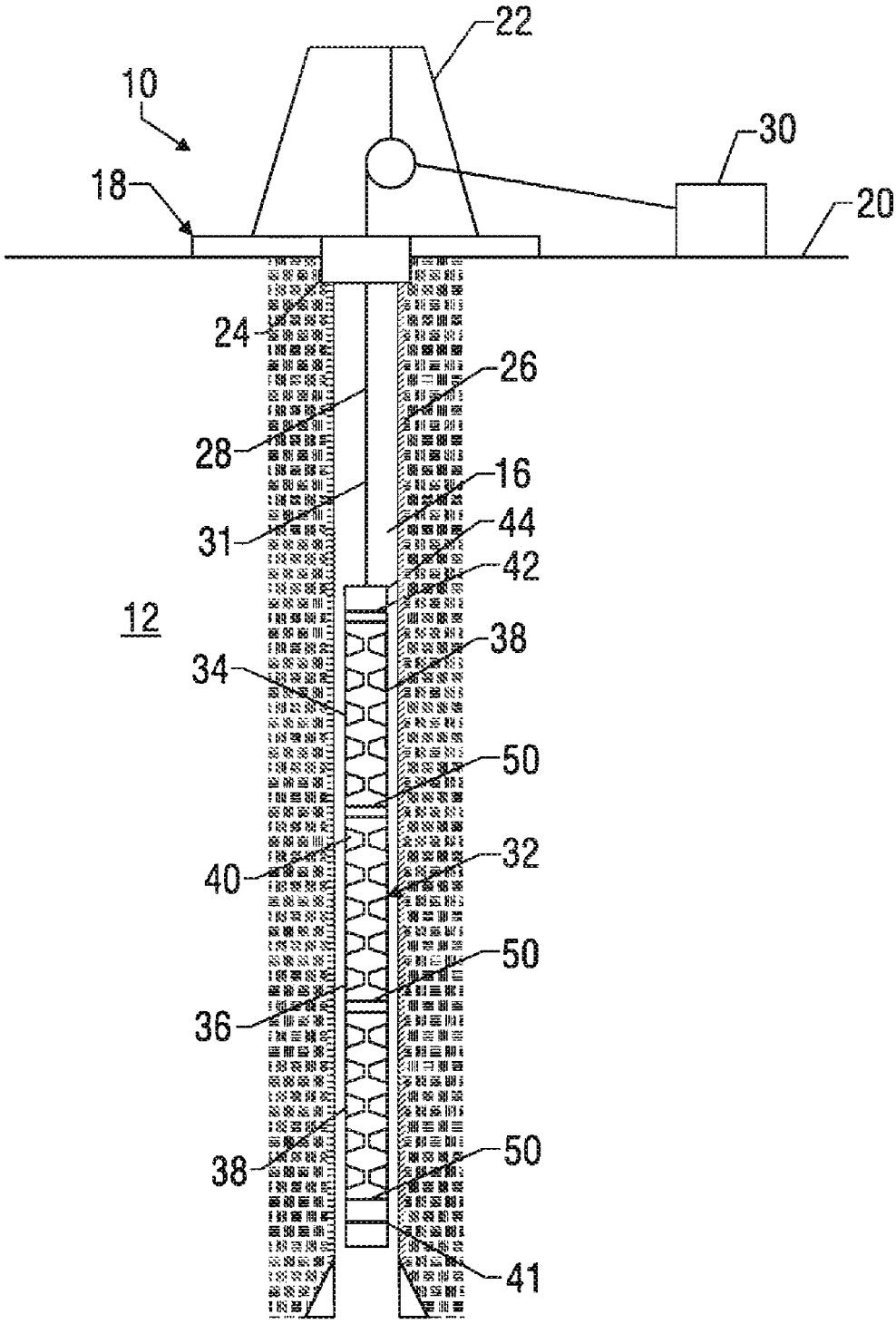
FIG. 1 schematically illustrates a deployment of a perforating gun train utilizing one embodiment of the present invention.

The present invention relates to devices and methods for selective firing one or more downhole tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is shown a well construction and/or hydrocarbon production facility 10 positioned over a subterranean formation of interest 12. The facility can be a land-based or offshore rig adapted to convey a tool, such as a perforating gun train, in a well bore 16. The wellbore 16 can include open hole sections and/or cased and cemented sections. The facility 10 can include known equipment and structures such as a platform 18 at the earth's surface 20, a derrick 22, a wellhead 24, and casing 26. A work string 28 suspended within the well bore 16 from the derrick 22 is used to convey tooling into the wellbore 16. The work string 28 can include drill pipe, coiled tubing, wire line, slick line, or any other known conveyance means. Further, the work string 28 can be pulled through the wellbore by a device such as a wellbore tractor (not shown), which may be advantageous in extended reach wells or deviated wells. The work string 28 can include telemetry lines or other signal/power transmission mediums that establish one-way or two-way telemetric communication from the surface to a tool connected to an end of the work string 28. A suitable telemetry system (not shown) can be known types as mud pulse, electrical signals, acoustic, or other suitable systems. For illustrative purposes, there is shown a telemetry system having a surface controller (e.g., a power source and/or firing panel) 30 adapted to transmit signals via a cable or signal transmission line 31 disposed in the work string 28. The signals can be analog or digital signals.

Figure 2:
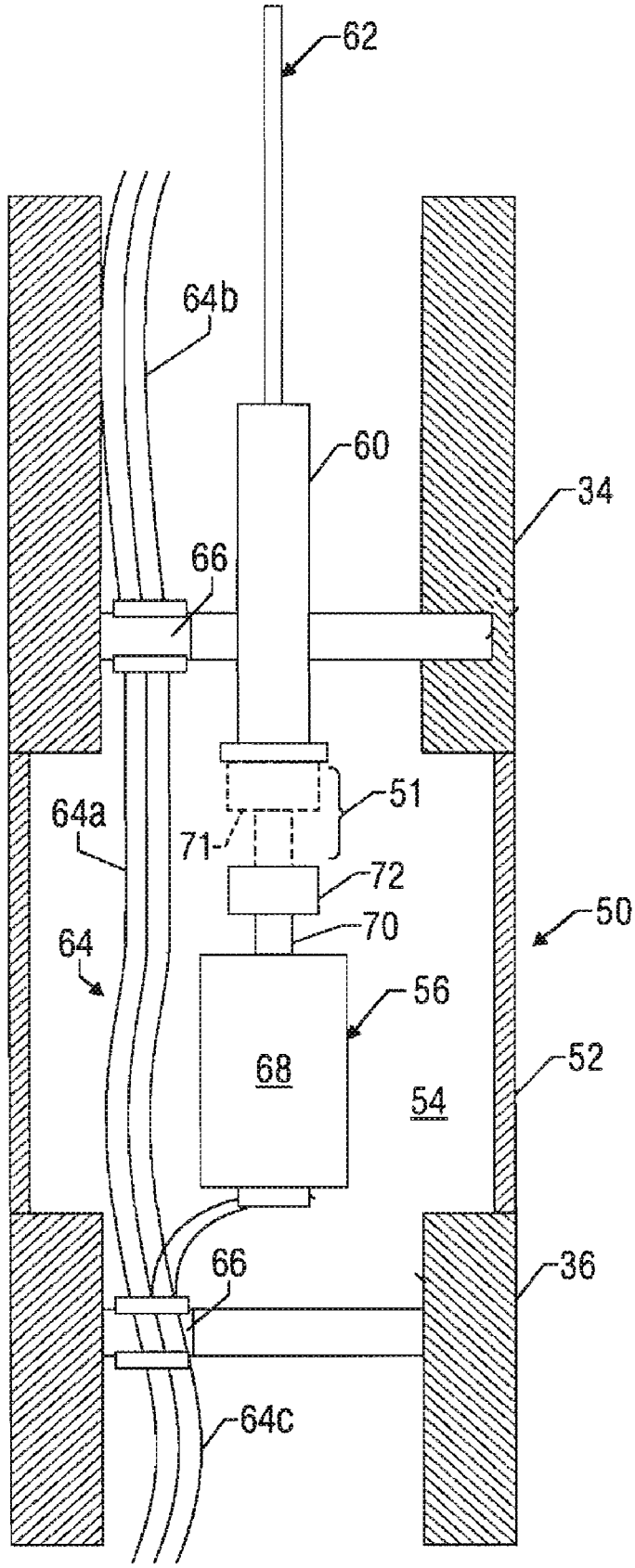
FIG. 2 schematically illustrates one embodiment of the present invention that is adapted to selectively permit transmission of signals to a downhole tool.

In one embodiment of the present invention, a perforating gun train 32 is coupled to an end of the work string 28. An exemplary gun train includes a plurality of gun or gun compartments 34, 36, 38, each of which includes perforating shaped charges 40. The shaped charges 40 of each individual gun, e.g., gun 34, are configured to fire as a group. Other equipment associated with the gun train 32 includes a bottom sub 41, a top sub 42, and an accessories package 44 that may carry equipment such as a casing collar locator, formation sampling tools, casing evaluation tools, etc. To enable selective firing the individual perforating guns 34, 36, 38, a fire control sub 50 is coupled to one or more of the guns 34, 36, 38. By "selective" it is meant that any of the guns 34, 36, 38 can be fired simultaneously, sequentially, and in any order. Moreover, the guns 34, 36, 38 can be fired in selected groupings such as initial firing of gun 34 and the simultaneously firing of guns 36 and 38. The select fire devices 50 are configured to provide selective and controllable electrical and ballistic connections to the guns 34, 36, 38. In certain embodiments, the select fire system can be made to perform integral with the guns 34, 36, 38. In other embodiments, as is shown in FIGS. 1 and 2, the select fire systems are disposed in modular subs as described herein below. It should be understood that the teachings of the present invention can be adapted for use with a single gun or a plurality of guns.

An exemplary select fire sub 50 controls the transmission of a firing signal from a signal source, which may be at the surface or downhole, to an associated gun 34, 36, 38. For example, the select fire sub 50 can selectively produce a gap 51 in the transmission medium conveying the firing signal. This gap or break in the transmission medium prevents a firing signal, whatever the form, e.g., electrical (analog or digital), ballistic, explosive, chemical, acoustic, etc., from initiating the donation of the guns 34, 36, 38. Thus, each individual gun 34, 36, 38 can be put into a "safe" mode wherein a gap or break in the transmission medium substantially isolates the gun from a firing signal and an "armed" mode wherein the gap or break is bridged to allow the fire signal to initiate the detonation of a gun.

Referring now to FIG. 2, in one embodiment, the fire control sub 50 is formed as a modular unit that can be selectively inserted into the gun train 32. Merely for illustrative purposes, the fire control sub 50 is shown interposed between guns 34 and 36. In a conventional manner, the gun 36 includes a detonator 60 for igniting a detonator cord 62. In this arrangement, the transmission medium used to transmit firing signals is an electrical conductor bundle 64. The bundle 64 includes signal transmission carriers coupled at one end to a surface controller such as the firing panel 30 and coupled to each of the guns 34, 36, 38 at the other end. The firing signal travels through the conductor bundle 64 and, if the control sub 50 permits, ultimately actuates the detonator 60 associated with each gun 34, 36, 38. As shown, the bundle 64 is positioned in the interior of the guns 34, 36 and sub 50, however, in other embodiments, the bundle 64 can be positioned on the exterior of the guns 34,36. Also, the bundle 64 can be formed of multiple lengths 64*a,b,c* that are coupled via suitable connectors 66.

The fire control sub 50 includes a modular mandrel or body 52 defining an interior space 54. Disposed in the interior space 54, is an operator 56 that is connected to the conductor bundle 64 and selectively couples or connects to the detonator 60. In the "safe" mode, a defined gap 51 is maintained between the operator 56 and the detonator 60. In the "armed" mode, the operator 56 closes the gap and forms a bridge through which the firing signal can pass from the conductor bundle 64 to the detonator 60. In this arrangement, this bridge is an electrical path but in other arrangements, the bridge can be a ballistic path, a hydraulic circuit, or other suitable transmission medium. One exemplary operator 56 includes a motor 68, a longitudinally movable shaft 70, and a contact head 72. Actuation of a motor 68 drives the shaft 70 longitudinally towards the detonator 60 until the contact head 72 mates with detonator 60. The shaft and contact head in the extended and contacted position are shown in hidden lines and labeled with numeral 71. In some arrangements, selected elements of the motor 68 and shaft 70 are made of conductive material such that the electrical circuit between the conductor bundle 64 and the detonator 60 is made up of the conductive portions of the shaft 70, the motor 68 and the contact head 72. It should be understood that some embodiments of the shaft 70 can be formed to mate with the detonator 60 without a contact head 72. Moreover, the motor 68 can be formed as a reversible motor to enable both closing and subsequent opening of the electrical circuit. In one arrangement, the operator 56 is configured to operate when supplied with electrical current of a first polarity (the control signal) and the detonator 60 is configured to be actuated by an electrical current of an opposite polarity (the firing signal).

While the gap 51 has been described as a void or space, it should be understood the term "gap" merely represents a discontinuity in the transmission medium. This discontinuity can also be formed by inserting a non-conductive material or insulator along the transmission path of the control signal.

While the operator 56 is shown as utilizing an electromechanical drive unit, the present invention is not limited to such devices. Rather, other drive units utilizing energy in the form of hydraulics, pneumatics, magnetics and explosives can also be use. For instance, the operator 56 can include a hydraulic or pneumatic pump that energizes a piston-cylinder arrangement. Other suitable arrangements can use frangible elements that, when fractured, releases a conductor that forms a bridge between the bundle 64 and the detonator 60.

Referring now to FIGS. 1 and 2, in one exemplary mode of operation, the gun train 62 is conveyed into the hole with the fire control subs 50 in the "safe" mode. After the train 62 is positioned in a section of the wellbore to be perforated, a control signal from a surface controller 30 is transmitted to one or more selected subs 50 to put the associated guns 34, 36, 38 in the "armed" mode. This may be a simultaneous or sequential transmission of control signals. Thereafter, the continuity check can be performed to verify that the selected sub or subs 50 have established the appropriate circuit(s). At this point, the firing signal or signals can be transmitted to detonate the selected gun(s). In some application, the gun train 32 can be moved to another location and another gun or gun compartment armed and fired, and so on.

In certain applications, a second control signal can be sent to the subs 50 to return to a "safe" mode. This may be advantageous, for example, if a malfunction has prevented a perforating gun from firing and the malfunctioning gun is to be extracted from the wellbore.

Figure 3:
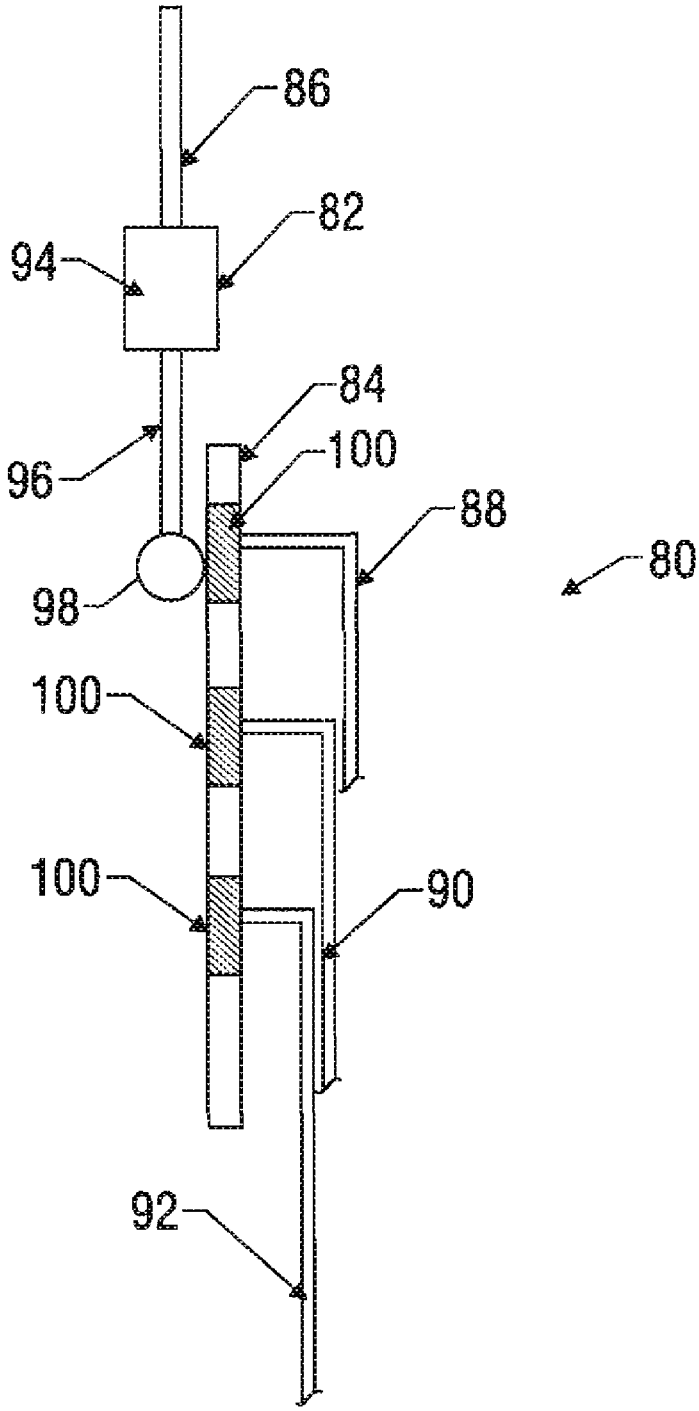
FIG. 3 schematically illustrates another embodiment of the present invention that is adapted to selectively permit transmission of signals to a downhole tool.

Referring now to FIG. 3, there is shown another embodiment of a fire control unit 80 made in accordance with the present invention. In the FIG. 3 embodiment, the select firing mechanism for a plurality of guns is consolidated in a single sub (not shown) that is inserted into the perforating gun train 32 (FIG. 1). The fire control unit 80 includes an operator 82 and a wiring harness 84. The operator 82 is coupled to a transmission medium such as an electrical conductor bundle 86 and the wiring harness 84 includes conductors 88,90,92, each of which are coupled to detonator assemblies of guns 34,36,38. In one embodiment, the operator includes a motor 94 that longitudinally drives a member such as a shaft 96 and associated contact head 98. The wiring harness 84 includes a plurality of contact plates 100 that are adapted to electrically couple with the contact head 98. In one arrangement, the contact head 98 initially does not contact any of the plates 100, which can be considered the "safe" mode. Actuation of the operator 82 causes the contact head 98 to move into engagement with each contact plate 100 in a serial fashion, which puts gun associated with the contact plate 100 in the "armed" mode.

In one exemplary deployment of the FIG. 3 embodiment, the perforating gun train 32 can be conveyed into the wellbore with the guns 34, 36, 38 in a "safe" mode. If, for instance, it is desired to fire gun 34, a control signal is transmitted to actuate the operator 82. In response to the control signal, the operator 82 moves the contact head 98 into engagement with the appropriate plate 100 for the conductors 88 leading to gun 34. Thereafter, a firing signal can be sent to detonate the gun 34.

While arrangements utilizing longitudinal motion have been described, it should be understood that other arrangements can also be used. For example, members such as complementary rotating disks can be used to selectively establish transmission paths between a signal source and one or more perforating guns. Also, merely for brevity the use of the fire control subs 50 have been discussed with reference to perforating guns. It should understood, however, that the fire control sub 50 can be utilized with other downhole tools such as pipe cutters.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An apparatus for perforating a wellbore, comprising:

(a) a gun train formed by serially coupling a plurality of guns, (b) a detonator assembly associated with each gun;

(c) a signal transmission medium for conveying a firing signal to each detonator assembly from a surface controller, the detonator assembly detonating the associated gun in response to the firing signal;

(d) an operator interposed between the signal transmission medium and at least one detonator assembly to enable selective transmission of the firing signal from the surface controller to the at least one detonator assembly, the operator allowing transmission of the firing signal to the at least one detonator assembly only in response to a control signal transmitted from the surface controller; and (e) a wiring harness having a contact plate coupled to the at least one detonator assembly, wherein the operator selectively engages the contact plate.

2. The apparatus according to claim 1, wherein the operator selectively substantially isolates the at least one detonator assembly by forming a gap in a signal path between the detonator and the signal transmission medium.

3. The apparatus according to claim 1, wherein the operator selectively forms a signal conducting path with the detonator, the firing signal being conveyed to the at least one detonator via the signal conducting path.

4. The apparatus according to claim 1, wherein the operator includes a motor for driving a shaft into contact with the detonator upon receiving the control signal.

5. The apparatus according to claim 1, wherein the signal transmission medium includes an electrical wiring bundle extending from the surface controller to the gun train.

6. An apparatus for providing selective firing of a gun train formed of a plurality of guns, each gun detonating upon receiving a firing signal conveyed by a signal transmission medium, the apparatus comprising:

(a) an operator selectively coupling at least one gun of the gun train to a signal transmission medium, the operator having a safe state wherein the operator isolates the gun from the firing signal conveyed by the signal transmission medium and an armed state wherein the operator forms a signal path between the gun and the signal transmission medium to thereby convey the firing signal to the gun, the operator moving from a safe state to an armed state upon receiving a control signal from a surface source, wherein the firing signal is an electrical signal of one polarity and the control signal is an electrical signal of a polarity opposite to that of the firing signal.

7. The apparatus according to claim 6, wherein the operator includes a conductive member that selectively engages the detonator.

8. The apparatus according to claim 6, wherein the operator includes a motor for moving a conductive member into engagement with the at least one gun to thereby form a signal path for transmitting the firing signal to the at least one gun.

9. The apparatus according to claim 6 further comprising at least two operators, each operator being associated with at least one gun.

10. The apparatus according to claim 6, wherein the operator is associated with at least two guns.

11. A method for perforating a wellbore, comprising:

(a) forming a gun train by serially coupling a plurality of guns, each gun being coupled to a detonator assembly;

(b) providing a signal transmission medium for conveying a firing signal to each the detonator, each the detonator assembly detonating an associated gun in response to the firing signal;

(c) connecting a first gun of the plurality of guns to the signal transmission medium with an operator, the operator being configured to selectively engage a first detonator assembly coupled to the first gun, the operator initially being disengaged from the first detonator assembly;

(d) conveying the gun train into the wellbore;

(e) positioning the gun train in the wellbore at a depth corresponding to a section of the wellbore to be perforated;

(f) transmitting a control signal to the operator from the surface, the operator engaging the first detonator assembly in response to the control signal;

(g) transmitting a firing signal to detonate the first detonator assembly and thereby fire the first gun, and (h) transmitting a third control signal to the first operator, the first operator disengaging from the first detonator upon receiving the third control signal.

12. The method according to claim 11, wherein the operator connects at least two guns to the signal transmission medium.

13. The method according to claim 11 further comprising:

(a) connecting a second gun to the signal conveyance medium using a second operator;

(b) transmitting a second control signal to the second operator from the surface, the second operator engaging a second detonator assembly in response to the second control signal; and (c) transmitting a second firing signal to detonate the second detonator assembly and thereby fire the second gun.

14. The method according to claim 13 further comprising transmitting the first and second firing signal at one of: (i) sequentially, and (ii) concurrently.

15. The method according to claim 13 further comprising repositioning the gun train after transmitting the first firing signal.

16. The method according to claim 11, wherein the first firing signal is one of: (i) an electrical signal, (ii) an acoustic signal, (iii) a pressure signal, (iv) a thermal signal, and (v) a ballistic signal.

17. The method according to claim 11, wherein the first control signal is one of: (i) an electrical signal, (ii) an acoustic signal, (iii) a pressure signal, (iv) a thermal signal, and (v) a ballistic signal.

18. An apparatus for providing selective firing of a gun train formed of a plurality of guns, each gun detonating upon receiving a firing signal conveyed by a signal transmission medium, the apparatus comprising:

(a) an operator selectively coupling at least one gun of the gun train to a signal transmission medium, the operator having a safe state wherein the operator isolates the gun from the firing signal conveyed by the signal transmission medium and an armed state wherein the operator forms a signal path between the gun and the signal transmission medium to thereby convey the firing signal to the gun, the operator moving from a safe state to an armed state upon receiving a control signal from a surface source, wherein the signal transmission medium is an electrical wiring bundle adapted to convey the firing signal and the control signal and the operator includes an electrical motor responsive to the control signal.

* * * * *

UNITED STATES PATENT AND TRADEMARK OFFICE

CERTIFICATE OF CORRECTION

PATENT NO. : 7,387,162 B2
APPLICATION NO. : 11/328683
DATED : June 17, 2008
INVENTOR(S) : James D. Mooney, Jr. and Bobby R. Ford It is certified that error appears in the above-identified patent and that said Letters Patent is hereby corrected as shown below:

In the claims, Claim 11, at column 7, line 21, please delete the phrase "to each the detonator, each the detonator" and insert therefor -- to each detonator, each detonator --.

Signed and Sealed this

Thirtieth Day of November, 2010

David J. Kappos

David J. Kappos
*Director of the United States Patent and Trademark Office*